US005156107A

United States Patent [19]

Kyuno et al.

[11] Patent Number: 5,156,107

[45] Date of Patent: Oct. 20, 1992

[54] SEWING MACHINE CAPABLE OF FORMING PLURAL STITCH PATTERNS

[75] Inventors: Mitsuyasu Kyuno, Nagoya; Kenichi Hashimoto, Kuwana, both of Japan

[73] Assignee: Brother Kogyo Kabushiki Kaisha, Nagoya, Japan

[21] Appl. No.: 763,564

[22] Filed: Sep. 23, 1991

[30] Foreign Application Priority Data

Oct. 25, 1990 [JP] Japan ..... 2-288208

[51] Int. Cl.[5] ..... D05B 3/02

[52] U.S. Cl. ..... 112/445; 112/454; 112/458

[58] Field of Search ..... 112/454, 456, 458, 453, 112/457, 121.11, 121.12, 445

[56] References Cited

U.S. PATENT DOCUMENTS 4,270,473 6/1981 Brienza ..... 112/445
4,413,574 11/1983 Hirota et al. ..... 112/456 X
4,499,836 2/1985 Meier et al. ..... 112/121.11 X
4,876,977 10/1989 Ando ..... 112/453 X
4,892,050 1/1990 Ando et al. ..... 112/456
4,942,836 7/1990 Sano et al. ..... 112/445
5,025,740 6/1991 Horie et al. ..... 112/456

FOREIGN PATENT DOCUMENTS 60-60890 4/1985 Japan .

*Primary Examiner*—Peter Nerbun
*Attorney, Agent, or Firm*—Oliff & Berridge

[57] ABSTRACT

In a sewing machine, a visual display provides the operator not only a representation of how a stitch pattern will appear but also provides dimension data in both the fabric feed direction and in a cross-feed, transverse, direction. The dimensions are determined by using width data for the widest element of the pattern, or the portion of the width of the elements extending above and below a reference line and adding the greatest uppermost and greatest lowermost extensions, and a sum of the length data for each element of the pattern.

15 Claims, 10 Drawing Sheets

Fig.4

| PATTERN | UPPERMOST POSITION DATA | LOWERMOST POSITION DATA | PATTERN LENGTH DATA |
|---|---|---|---|
| A | 1.5 | 0 | 1.2 |
| B | 1.5 | 0 | 1.2 |
| C | 1.5 | 0 | 1.2 |
| d | 1.3 | 0 | 0.9 |
| e | 0.7 | 0 | 0.5 |
| f | 1.5 | 0.4 | 0.7 |
| g | 0.9 | 0.3 | 0.7 |
| k | 1.5 | 0 | 1.0 |
| l | 1.4 | 0 | 0.7 |
| m | 0.8 | 0 | 1.2 |
| n | 0.8 | 0 | 0.8 |

Fig.5

| ADDRESS | UPPERMOST POSITION DATA | LOWERMOST POSITION DATA | PATTERN LENGTH DATA |
|---|---|---|---|
| 0001 | 1.5 | 0 | 1.2 |
| 0002 | 0.8 | 0 | 0.8 |
| 0003 | 0.9 | 0.3 | 0.7 |
| 0004 | 0.7 | 0 | 0.5 |
| 0005 | 1.4 | 0 | 0.7 |
| 0006 | | | |

Fig.10

| PATTERN | PATTERN WIDTH DATA | PATTERN LENGTH DATA |
|---|---|---|
| A(L) | 2.5 | 2 |
| A(M) | 1.5 | 1 |
| A(S) | 0.8 | 0.7 |
| B(L) | 2.5 | 2 |
| B(M) | 1.5 | 1 |
| B(S) | 0.8 | 0.7 |
| C(L) | 2.5 | 2 |
| C(M) | 1.5 | 1 |
| C(S) | 0.8 | 0.7 |

Fig.11

| ADDRESS | PATTERN WIDTH DATA | PATTERN LENGTH DATA |
|---|---|---|
| 0001 | 0.8 | 0.7 |
| 0002 | 1.5 | 1 |
| 0003 | 2.5 | 2 |
| 0004 | 1.5 | 1 |
| 0005 | 0.8 | 0.7 |
| 0006 | | |

SEWING MACHINE CAPABLE OF FORMING PLURAL STITCH PATTERNS

BACKGROUND OF THE INVENTION

1. Field of the Invention

This invention relates to a sewing machine for automatically forming a plurality of stitch patterns selected from among a large number of predetermined juxtaposed patterns.

2. Description of Related Art

A sewing machine with which a plurality of stitch patterns selected from among a large number of predetermined patterns are juxtaposed is disclosed in Japanese Patent Laid-Open Publication No. 60-60890. The sewing machine includes a display device. The display device displays thereon a total length of the selected patterns, that is, a total length of a combination pattern, in a direction in which the patterns are juxtaposed. Such a direction will be hereinafter referred to as pattern arrangement direction. According to the sewing machine, an operator can confirm, before starting sewing, a total length of a combination pattern consisting of a plurality of selected patterns. Therefore, the operator can avoid forming a combination pattern that, when sewn, extends beyond a predetermined sewing area.

While the sewing machine can display a total length of a combination pattern in its pattern arrangement direction, it cannot display a total length of a combination pattern in a direction perpendicular to its pattern arrangement direction. Such a perpendicular direction will be hereinafter referred to as pattern widthwise direction. In particular, in the sewing machine, no attention is paid to the protrusion of a combination pattern from the predetermined sewing area in a pattern widthwise direction. The operator cannot confirm the total length of a combination pattern in a pattern widthwise direction before starting sewing. Therefore, the sewing machine has a problem that a combination pattern may be formed that extends beyond the predetermined sewing area on a fabric or a combination pattern may be formed in a partially overlapping relationship in a pattern widthwise direction with another pattern previously formed on the fabric.

SUMMARY OF THE INVENTION

It is an object of the invention to provide a sewing machine wherein a combination pattern can be prevented from being formed beyond a predetermined sewing area on a fabric in a pattern widthwise direction.

In order to attain the object, according to the invention, there is provided a sewing machine capable of forming a plurality of stitch patterns, which comprises: size data storage means for storing therein size data related to sizes of a plurality of predetermined patterns; pattern selecting means for selecting a desired pattern from among the plurality of predetermined patterns; combination designating means for successively combining patterns selected by the pattern selecting means; stitch forming means for forming a plurality of patterns combined by the combination designating means to be juxtaposed in a pattern arrangement direction to form a combination pattern; pattern width calculating means for calculating a total length of a combination pattern to be formed by the stitch forming means in a pattern widthwise direction perpendicular to the pattern arrangement direction based on the size data stored in the size data storage means to determine a width of the combination pattern; and display means for displaying a width of the combination pattern calculated by the pattern width calculating means.

In the sewing machine of the present invention, the size data storage means stores therein size data related to sizes of a plurality of predetermined patterns. The pattern selecting means selects a desired pattern from among the plurality of predetermined patterns. The combination designating means successively combines patterns selected by the pattern selecting means. The stitch forming means forms the patterns combined by the combination designating means to be juxtaposed in a pattern arrangement direction to form a combination pattern. The pattern width calculating means calculates, based on the size data stored in the size data storage means, a total length of a combination pattern to be formed by the stitch forming means in a pattern widthwise direction perpendicular to the pattern arrangement direction to determine a width of the combination pattern. The display means displays the width of the combination pattern calculated by the pattern width calculating means.

According to the sewing machine of the present invention, a total length of a combination pattern in its pattern widthwise direction, i.e., a width of the combination pattern is displayed on the display means. Accordingly, an operator can confirm the width of the combination pattern before starting sewing. Therefore, a combination pattern selected can avoid protruding from a predetermined sewing area on a fabric in a pattern widthwise direction.

BRIEF DESCRIPTION OF THE DRAWINGS

A preferred embodiment of the present invention will be described in detail with reference to the following figures, wherein:

FIG. 4 is a table illustrating stored contents of a ROM (read only memory) of the sewing machine;

FIG. 5 is a table illustrating stored contents of a RAM (random access memory) of the sewing machine;

FIG. 10 is a table illustrating stored contents of a ROM of the second sewing machine;

FIG. 11 is a table illustrating stored contents of a RAM of the second sewing machine;

DETAILED DESCRIPTION OF THE PREFERRED EMBODIMENTS

Figure 1:
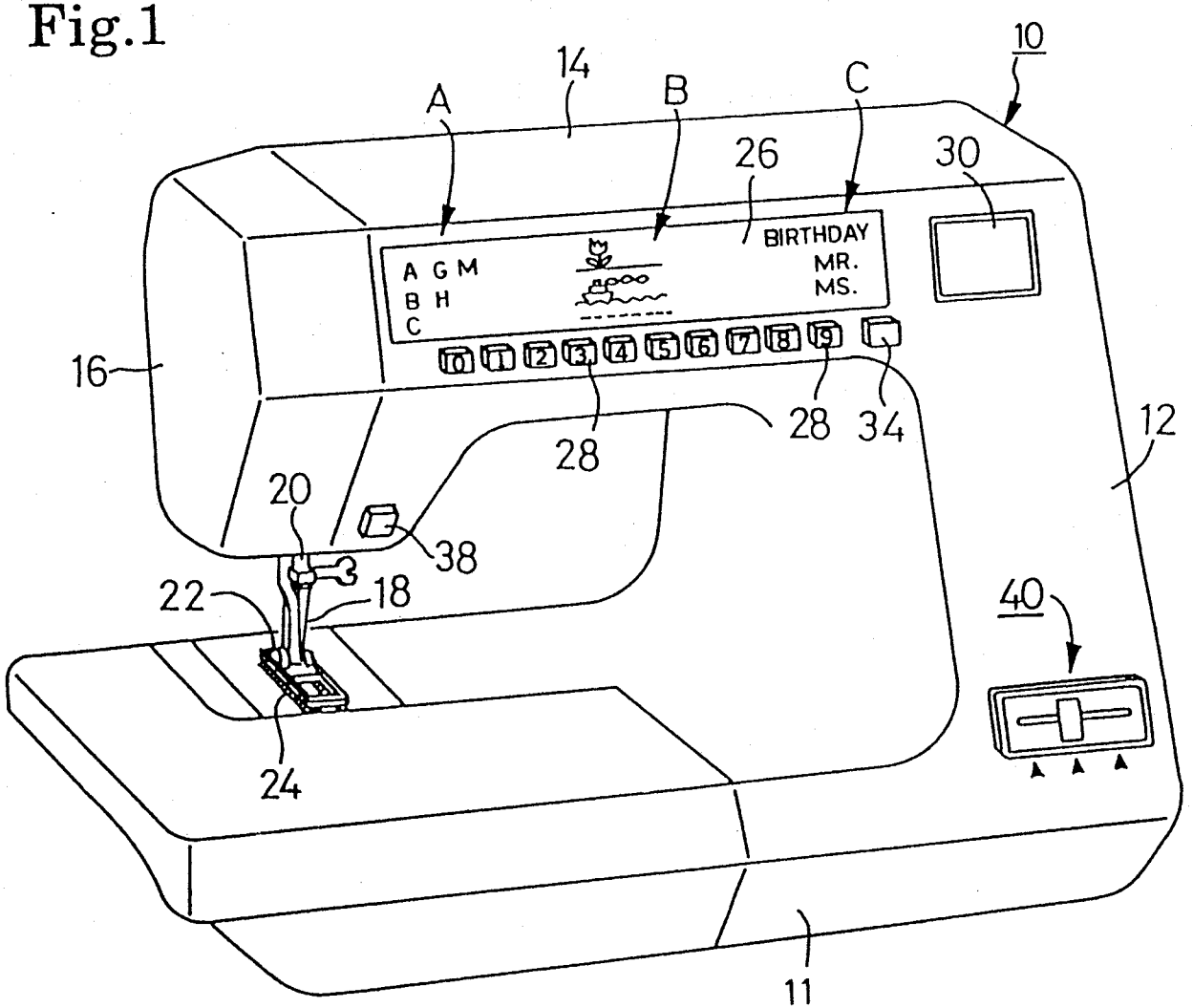
FIG. 1 is a perspective view showing a sewing machine to which a first embodiment of the invention is applied.
Figure 2:
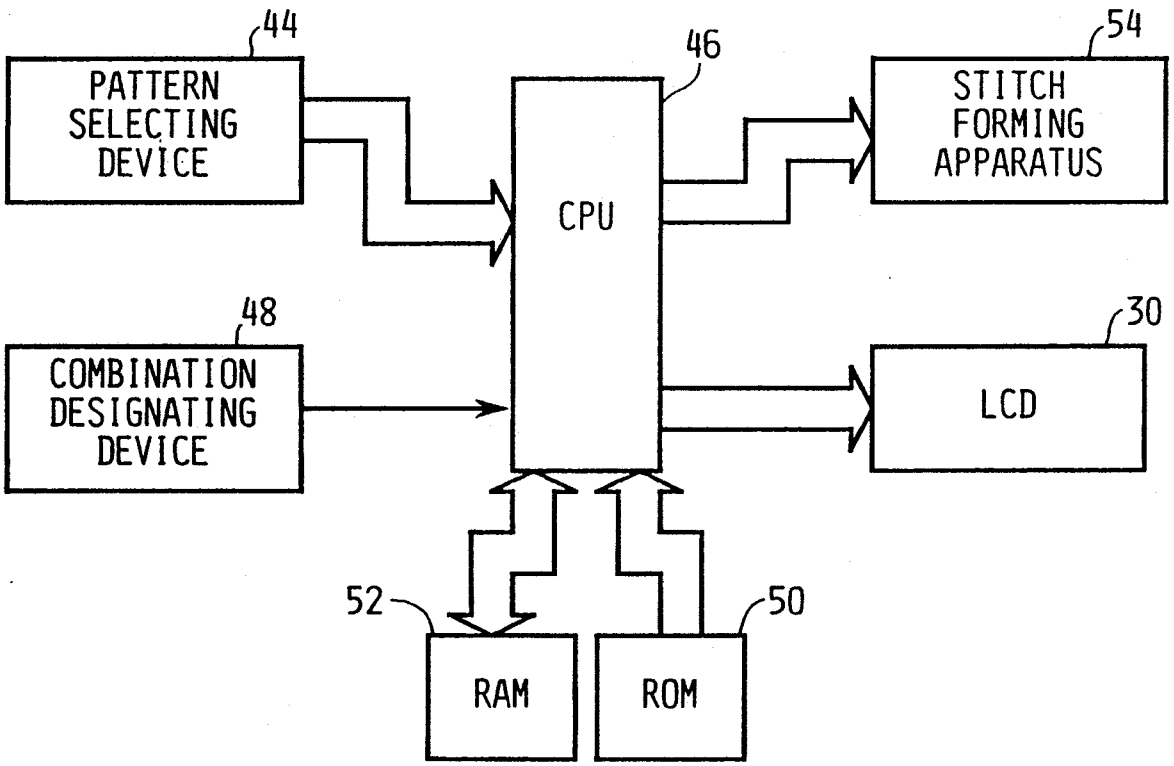
FIG. 2 is a block diagram showing the electrical structure of the sewing machine.

A first embodiment of the present invention will be described with reference to FIGS. 1 to 8. As shown in FIG. 1, a column portion 12 is provided uprightly on a bed portion 11 of a sewing machine 10. One end of an arm portion 14 is supported horizontally at the end of the column portion 12. A head portion 16 is formed at the other end portion of the arm portion 14. A needle bar 20 having a sewing needle 18 attached thereto is supported for upward and downward movement and also for rocking motion on the head portion 16. The needle bar 20 is driven to reciprocate in the upward and downward directions and the leftward and rightward directions in synchronization with rotation of a main shaft, not shown, provided in the arm portion 14. A presser foot 22 is supported for upward and downward movement on the head portion 16. The presser foot 22 can be moved between its lifted position and lowered position manually. A feed dog 24 is provided adjacent the location of the sewing needle 18, on the bed portion 11, and is driven to reciprocate in synchronization with the rotation of the sewing machine main shaft to feed a work fabric forwardly or rearwardly and/or leftwardly or rightwardly. A sewing machine motor, not shown, for rotating the main shaft is provided in the bed portion 11.

A pattern display section 26 is provided on the face of the arm portion 14. A large number of patterns belonging to three groups A, B and C are displayed on the pattern display section 26, the patterns having sizes smaller than those of the stitch patterns actually formed on a work fabric, together with two digit pattern identification numbers (not shown). Patterns belonging to group B include continuous stitch patterns including practical stitches, such as a straight stitch and a zigzag pattern stitch, and ornamental patterns. Patterns belonging to the group A include characters, numeric figures, and symbols. Patterns belonging to group C include common series of patterns or series of characters, numeric figures, and symbols. Accordingly, patterns belonging to groups A or C are cyclic patterns, each of which is sewn separately. However, the subject matter of the groups, as described herein, is for purposes of explanation. Other groupings could just as easily be employed.

A total of ten pattern selecting switches 28 for selecting a desired pattern are disposed below the pattern display section 26. A number is embossed on each of the ten pattern selecting switches 28. An LCD 30 is provided on the right-hand side of the pattern display section 26. The LCD 30 displays the name or shape of a pattern, the dimension of the pattern in a forward and rearward feeding direction (pattern arrangement direction) of a work fabric, and actual dimensions of the pattern in a needle rocking direction and a work fabric leftward and rightward feeding direction (pattern widthwise direction). A combination designating switch 34 is disposed on the right-hand side of the pattern selecting switches 28 and a start/stop switch 38 for starting or stopping the sewing machine 10 is provided at a lower end portion of the head portion 16. A speed setting device 40 for setting the speed of the sewing machine motor to a predetermined value is provided at a lower end portion of the column portion 12.

The electrical structure of the sewing machine 10 described above will be described with reference to FIG. 2. A pattern selecting device 44 includes the pattern selecting switches 28. When a pattern selecting switch 28 is operated by an operator, the pattern selecting device 44 supplies a pattern code to a CPU 46 corresponding to the selected switch. A combination designating device 48 is constructed to include the combination designating switch 34. When the combination designating switch 34 is operated by an operator, the combination designating device 48 supplies a combination designating signal to the CPU 46.

Figure 3:
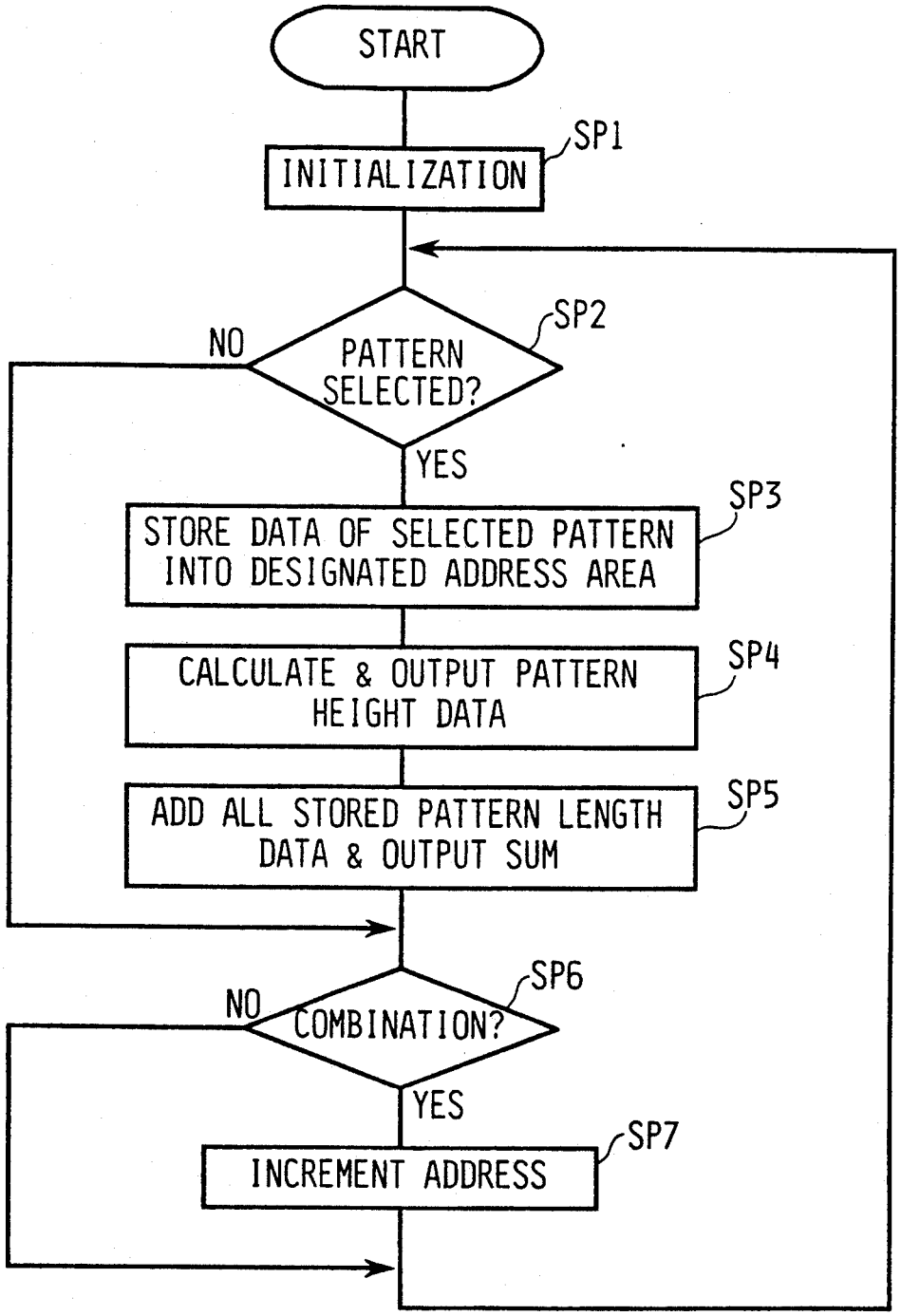
FIG. 3 is a flow chart illustrating operation of a CPU (central processing unit) of the sewing machine.

The CPU 46, when power is supplied to the sewing machine 10, operates as shown in the flow chart of FIG. 3. A ROM 50 has stored therein the programs for operating the CPU 46, stitch data for forming various patterns and display data for allowing the shapes of the patterns to be displayed. The ROM 50 further stores therein such uppermost position data and lowermost position data representative of sizes of various patterns in a pattern widthwise direction and pattern length data representative of sizes of the patterns in a pattern arrangement direction as seen in the table shown in FIG. 4.

Figure 6:
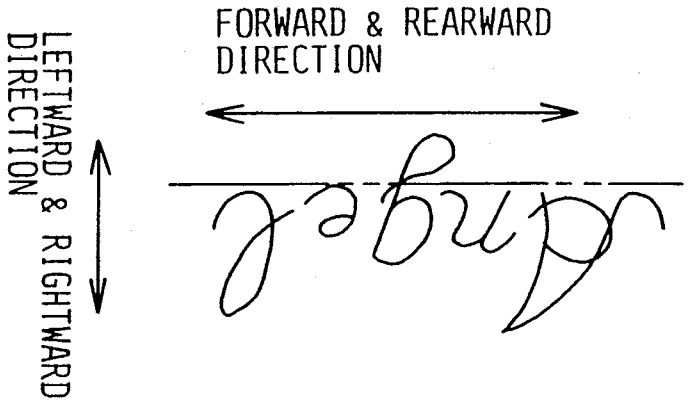
FIG. 6 is an illustration showing a pattern formed by the sewing machine.

The RAM 52 stores pattern codes corresponding to selected patterns in an order in which they are to be combined. The RAM 52 further stores temporarily therein uppermost and lowermost position data and pattern length data of the patterns in the order in which they are to be combined as shown in the table shown in FIG. 5. It is to be noted that, in FIGS. 4 and 5, data are represented not in the form of actually stored data but in the form of actual patterns and sizes for convenience. Description will be given subsequently of a manner in which uppermost position data and lowermost position data are determined. In particular, a distance in the rightward direction from a reference line extending in the forward and rearward direction and indicated by an alternate long and two short dashes line in FIG. 6 is determined as uppermost position data. Meanwhile, a distance in the leftward direction from the reference line is determined as lowermost position data.

A stitch forming apparatus 54 includes the sewing needle 18 and the feed dog 24. The stitch forming apparatus 54 drives the sewing needle 18 and the feed dog 24 in accordance with a signal supplied thereto from the CPU 46. It is to be noted that the detailed construction of an apparatus for causing rocking motion of the sewing needle 18 and another apparatus for causing forward and backward motion and leftward and rightward motion of the feed dog 24 are similar to those of an apparatus disclosed in U.S. Pat. No. 5,063,867, issued Nov. 12, 1991 accordingly, detailed description thereof is omitted herein. The U.S. Pat. No. 5,063,867 is incorporated by reference. The LCD 30 displays, in accordance with a signal supplied from the CPU 46, the name or shape of a pattern, the dimensions of the pattern in a forward and rearward feeding direction (pattern arrangement direction) of a work fabric, and the dimensions of the pattern in a needle rocking direction and a work fabric leftward and rightward feeding direction (pattern widthwise direction).

Operation of the sewing machine 10 having such a construction as described above will be described with reference to the flow chart of FIG. 3. It is to be noted that the reading of the data from the ROM 50, the storing of the data into the RAM 52 and the outputting of the data to the stitch forming apparatus 54 upon pattern selection by the CPU 46 are similar to those of the apparatus disclosed in Japanese Patent Laid-Open Publication No. 60-60890, and accordingly, detailed description thereof will be omitted herein. Japanese Patent Laid-Open Publication No. 60-60890 is incorporated by reference.

After power is applied to the sewing machine 10, the CPU 46 executes an initializing operation at step SP1. The initializing operation also includes an operation of setting to 0001 an address value which designates an area of the RAM 52 into which pattern dimension data are to be stored.

Subsequently, if an operator operates the pattern selecting switches 28 to select, for example, a pattern "A" in order to form a combination pattern, such as shown in FIG. 6, a pattern code representative of the pattern "A" is supplied from the pattern selecting device 44 to the CPU 46. When the CPU 46 judges selection of the pattern at step SP2, at step SP3 the CPU 46 stores the pattern code corresponding to the pattern "A" into the RAM 52. The CPU 46 then reads, from the ROM 50, display data for allowing a shape of the pattern "A" to be displayed and outputs the display data to the LCD 30. The CPU 46 then reads, from the ROM 50, uppermost position data (1.5), lowermost position data (0) and pattern length data (1.2), shown in FIG. 4, corresponding to the pattern "A". Then, the CPU 46 stores the uppermost position data (1.5), lowermost position data (0) and pattern length data (1.2), corresponding to the pattern "A", into a storage area of the address value 0001 of the RAM 54 as seen in FIG. 5.

Subsequently, the CPU 46 selects, at step SP4, maximum values among the uppermost position data and lowermost position data stored in the storage areas of the address values of 0001 et seq. of the RAM 54. The CPU 46 adds the thus selected uppermost position data and lowermost position data to determine pattern height data and outputs the thus determined pattern height data to the LCD 30. In the case where only the pattern "A" is selected, only one uppermost position data and only one lowermost position data are stored in the storage areas of the address values of 0001 et seq. of the RAM 54, and accordingly, the CPU 46 adds the uppermost position data (1.5) and the lowermost position data (0) of the pattern "A" and outputs pattern height data (1.5) obtained by such addition.

Figure 7:
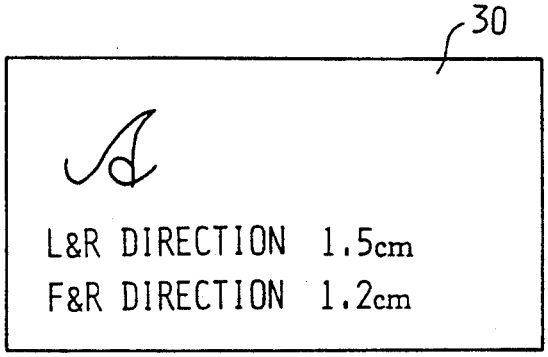
FIG. 7 is an illustration showing a displaying condition of an LCD (liquid crystal display) of the sewing machine.

At step SP5, the CPU 46 adds all of pattern length data stored in the storage areas of the address values of 0001 et seq. of the RAM 54 and outputs the sum to the LCD 30. In the case where only the pattern "A" is selected, only one pattern length data is stored in the storage areas of the address value of 0001 et seq. of the RAM 54 and, accordingly, the CPU 46 outputs the pattern length data (1.2) of the pattern "A". As a result, the LCD 30 produces a display, as shown in FIG. 7, in accordance with the display data of pattern height data (1.5) and pattern length data (1.2) supplied thereto. It is to be noted that, since patterns in the present embodiment are arranged in a horizontal row in the forward and rearward direction, as viewed by an operator (FIG. 6), pattern height data are displayed as a distance in the leftward and rightward direction while pattern length data are displayed as a distance in the forward and rearward direction.

If an operator operates the combination designating switch 34 in order to combine a pattern "n" with the pattern "A", then the combination designating switch 34 supplies a combination designating signal to the CPU 46. When such combination designating signal is received, the CPU 46 judges at step SP6 whether the combination designating switch 34 has been operated, and the control sequence advances to step SP7. At step SP7, the CPU 46 increments the address value 0001 to obtain a new address value 0002 which designates an area into which uppermost and lowermost position data and pattern length data of a next pattern are to be stored. Then, the CPU 46 returns the control sequence to step SP2. When the pattern "n" is selected as the next pattern, steps SP3, SP4 and SP5 are again executed. If the combination designating switch 34 is operated at step SP6, in order to combine a further pattern "g" with the pattern "n", the CPU 46 executes step SP7 and returns the control sequence to step SP2.

Figure 8:
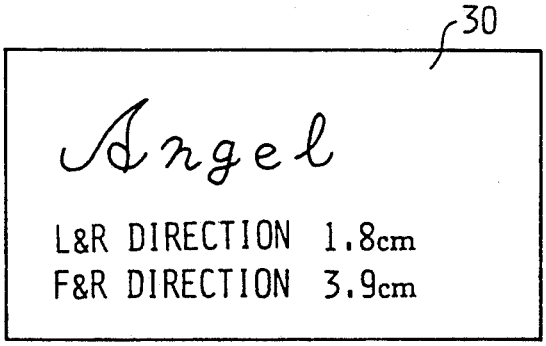
FIG. 8 is a similar view but showing another displaying condition of the LCD of the sewing machine.

After steps SP2 to SP7 are repeated to select and combine the patterns "A", "n", "g", "e" and "1", such data as seen in FIG. 5 are stored in the storage areas of the address values of 0001 through 00005, in order of entry, of the RAM 54. The shapes of the patterns and distances of the entire combination pattern in the leftward and rightward direction and also in the forward and rearward direction are displayed on the LCD 30 (FIG. 8). In this instance, the maximum uppermost position data among the patterns of the combination are the uppermost position data (1.5) of the pattern "A". Meanwhile, the maximum lowermost position data among the patterns of the combination are the lowermost position data (0.3) of the pattern "g". Accordingly, the uppermost position data (1.5) of the pattern "A" and the lowermost position data (0.3) of the pattern "g" are added to obtain pattern height data (1.8). The pattern height data (1.8) are displayed as a distance of the combination pattern in the leftward and rightward direction. Further, the pattern length data of all of the patterns (1.2, 0.8, 0.7, 0.5, 0.7) are added and a value of 3.9, obtained by the addition, is displayed as a distance of the combination pattern in the forward and rearward direction.

Since an operator can identify the placement and dimensions of the combination pattern as applied to the work fabric by observing the values displayed on the LCD 30, accurate positioning of the work fabric with respect to the sewing needle 18 can be accomplished readily. Then, if the start/stop switch 38 is operated by the operator, the sewing machine starts the sewing operation to form the combination pattern (FIG. 6) at the predetermined position on the work fabric.

A second embodiment of the present invention will be described with reference to FIGS. 9 to 14. It is to be noted that description of elements common to those of the first embodiment will be omitted herein.

Figure 9:
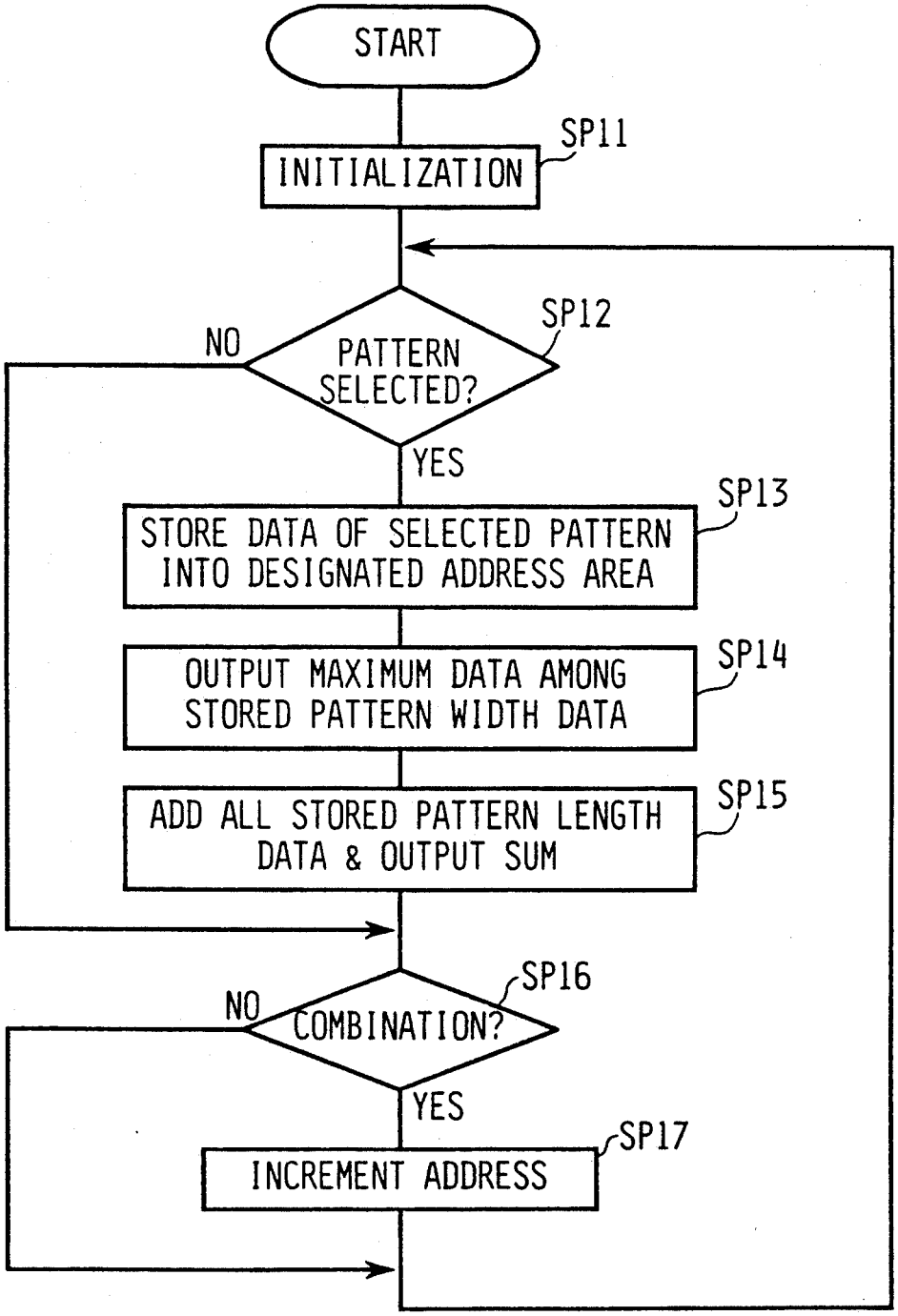
FIG. 9 is a flow chart illustrating part of the operation of a CPU of a sewing machine to which a second embodiment of the invention is applied.

In the present embodiment, the CPU 46 is constructed such that, when power is made available to the sewing machine 10, it operates in accordance with a flow chart shown in FIG. 9. The ROM 50 has stored therein a program for operating the CPU 46, stitch data for forming various patterns and display data for allowing the shape of a pattern to be displayed. The ROM 50 further has stored therein pattern width data and pattern length data representative of sizes of various patterns as shown in the table of FIG. 10. The RAM 52 stores therein pattern codes corresponding to selected patterns in an order in which the patterns are combined. The RAM 52 further stores temporarily therein pattern width data and pattern length data of patterns in an order in which the patterns are combined as seen in the table of FIG. 11. It is to be noted that, in FIGS. 10 and 11, data are represented not in the form of actually stored data but in the form of actual patterns and sizes for convenience.

Operation of the sewing machine 10 of the present embodiment will be described with reference to the flow chart of FIG. 9. After power is made available to the sewing machine 10, the CPU 46 executes an initializing operation at step SP11. The initializing operation also includes setting to 0001 an address value which designates an area of the RAM 52 into which pattern width and length data are to be stored.

Figure 12:
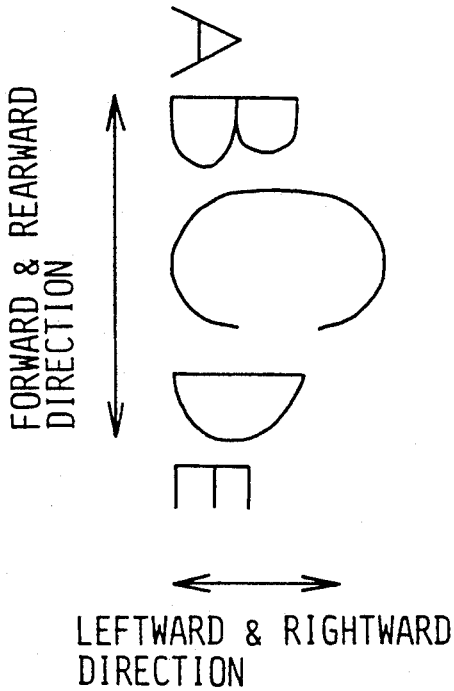
FIG. 12 is an illustration showing a pattern formed by the second sewing machine.
Figure 13:
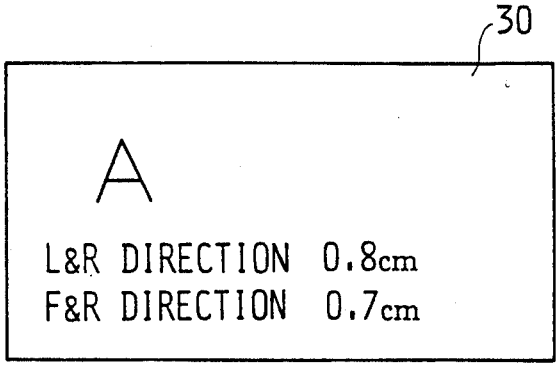
FIG. 13 is an illustration showing a displaying condition of an LCD of the second sewing machine.

Subsequently, if an operator operates the pattern selecting switch 28 at step 12 to select, for example, a pattern "A" of a small size in order to start forming a combination pattern, as shown in FIG. 12, a pattern code representative of the small size pattern "A" is supplied from the pattern selecting device 44 to the CPU 46. At step SP13, the CPU 46 stores a pattern code corresponding to the small size pattern "A" into the RAM 52. The CPU 46 then reads, from the ROM 50, display data for allowing a shape of the small size pattern "A" to be displayed and outputs the display data to the LCD 30. The CPU 46 then reads, from the ROM 50, pattern width data (0.8) and pattern length data (0.7), shown in FIG. 10, corresponding to the small size pattern "A" and stores the pattern width data (0.8) and pattern length data (0.7), corresponding to the small size pattern "A", into the storage area of the address value 0001 of the RAM 54 as seen in FIG. 11.

Subsequently, the CPU 46 selects, at step SP14, a maximum value among the pattern width data stored in the storage areas of the address values of 0001 et seq. of the RAM 54 and outputs the data to the LCD 30. In the case where only the small size pattern "A" is selected, only one pattern width data is stored in the storage areas of the address values of 0001 et seq. of the RAM 54 and, accordingly, the CPU 46 outputs the pattern width data (0.8) of the small pattern "A". Subsequently, the CPU 46 adds, at step SP15, all of pattern length data stored in the storage areas of the address values of 0001 et seq. of the RAM 54 and outputs the sum to the LCD 30. In the case where only the small size pattern "A" is selected, only one pattern length data is stored in the storage areas of the address values 0001 et seq. of the RAM 54 and, accordingly, the CPU 46 outputs the pattern length data (0.7) of the small size pattern "A". As a result, the LCD 30 displays the pattern width data and pattern length data supplied thereto. It is to be noted that patterns in the present embodiment are arranged in a horizontal row in the forward and rearward direction as viewed by an operator, shown in FIG. 12. Therefore, the pattern width data are displayed as a distance in the leftward and rightward direction while pattern length data are displayed as a distance in the forward and rearward direction.

If the operator operates the combination designating switch 34, in order to combine a pattern "B" of a medium size with the small size pattern "A", the combination designating switch 34 supplies a combination designating signal to the CPU 46. When such combination designating signal is received, the CPU 46 judges at step SP16 that the combination designating switch 34 has been operated and the control sequence advances to step SP17. At step SP17, the CPU 46 increments the address value 0001 to obtain a new address value 0002 which designates the area into which pattern width data and pattern length data of the next pattern are to be stored. Then, the CPU 46 returns the control sequence to step SP12. When the medium size pattern "B" is selected as a next pattern, the steps SP13, SP14 and SP15 described above are executed. If the combination designating switch 34 is again operated at step SP16, in order to combine a further pattern "C" of a large size with the medium size pattern "B", the CPU 46 executes the processing at step SP17 described above and then returns the control sequence to step SP12.

Figure 14:
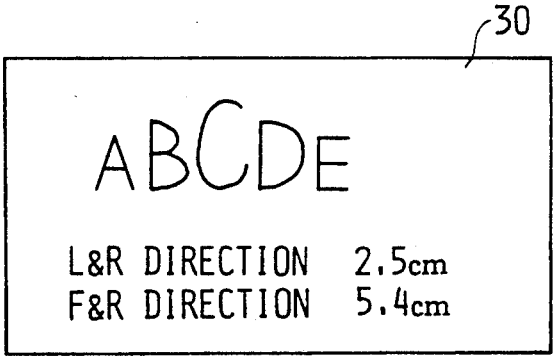
FIG. 14 is a similar view but showing another displaying condition of the LCD of the second sewing machine.

After the processings at steps SP12 to SP17 are repeated to select and combine the chosen patterns, such as the small size pattern "A", medium size pattern "B", large size pattern "C", medium size pattern "D" and small size pattern "E", of this example shown in FIG. 11, the pattern width and length data are stored in the storage areas of the address values of 0001 et seq. of the RAM 54. Further, the shapes of the patterns and the dimensions of the combination pattern in the leftward and rightward direction and the forward and rearward direction are displayed on the LCD 30 as shown in FIG. 14. In particular, the pattern width data (2.5) of the large size pattern "C" is displayed as a distance in the leftward and rightward direction. Further, the pattern length data of all of the patterns (0.7, 1, 2, 1, 0.7) are added, and a value of 5.4, obtained by the addition, is displayed.

Since the operator can observe the dimensions of the entire combination pattern of the selected patterns displayed on the LCD 30, accurate positioning of the work fabric with respect to the sewing needle 18 can be performed quickly such that the finished, sewn pattern lies completely within the desired sewing area. Then, if the start/stop switch 38 is operated by the operator, the sewing machine starts a known sewing operation to form the combination pattern, shown in FIG. 12, at the predetermined position on the work fabric.

The present invention is not limited to the first and second embodiments described in detail hereinabove, and many changes and modifications can be made thereto without departing from the spirit and scope of the invention as set forth herein.

For example, while a work fabric is fed by the feed dog 24 in the first and second embodiments, it may otherwise be fed using an embroidery frame or the like on which it is held.

What is claimed is:

1. A sewing machine capable of forming a plurality of stitch patterns, comprising:

size data storage means for storing therein size data related to sizes of a plurality of predetermined patterns;

pattern selecting means for selecting a desired pattern from among the plurality of predetermined patterns;

combination designating means for successively combining patterns selected by said pattern selecting means;

stitch forming means for forming a plurality of patterns combined by said combination designating means juxtaposed in a pattern arrangement direction to form a combination pattern;

pattern width calculating means for calculating a total length of the combination pattern to be formed by said stitch forming means in a pattern widthwise direction perpendicular to the pattern arrangement direction based on the size data stored in said size data storage means to determine a maximum width of the combination pattern; and display means for simultaneously displaying the pattern and the maximum width of the combination pattern calculated by said pattern width calculating means.

2. The sewing machine according to claim 1, further comprising:

stitch data storage means for storing therein stitch data corresponding to the plurality of predetermined patterns, wherein said stitch forming means forms a plurality of stitch patterns combined by said combination designating means in the pattern arrangement direction in accordance with the stitch data stored in said stitch data storage means.

3. The sewing machine according to claim 1, further comprising pattern length calculating means for calculating a total length of the combination pattern to be formed by said stitch forming means in the pattern arrangement direction based on the size data stored in said size data storage means to determine a length of the combination pattern.

4. The sewing machine according to claim 3, wherein said display means displays the length of the combination pattern calculated by said pattern length calculating means in addition to the width of the combination pattern.

5. A sewing machine capable of forming a plurality of stitch patterns, comprising:

pattern selecting means for selecting a desired pattern from among a plurality of predetermined patterns;

combination designating means for successively combining patterns selected by said pattern selecting means;

stitch forming means for forming a plurality of patterns combined by said combination designating means juxtaposed in a pattern arrangement direction to form a combination pattern;

position data storage means for storing therein lowermost position data and uppermost position data representing lowermost positions and uppermost positions of the plurality of predetermined patterns in a pattern widthwise direction perpendicular to the pattern arrangement direction;

read-out means for reading from said position data storage means a plurality of lowermost position data and uppermost position data individually corresponding to a plurality of patterns combined by said combination designating means;

data selecting means for selecting, from among a plurality of lowermost position data and uppermost position data read by said read-out means, lowermost position data and uppermost position data which represent the lowest position and the highest position, respectively;

calculating means for calculating a total widthwise dimension in the pattern widthwise direction of a combination pattern to be formed by said stitch forming means based on lowermost position data and uppermost position data selected by said data selecting means; and display means for displaying a widthwise dimension calculated by said calculating means.

6. The sewing machine according to claim 5, further comprising:

stitch data storage means for storing therein stitch data corresponding to the plurality of predetermined patterns, wherein said stitch forming means forms a plurality of stitch patterns combined by said combination designating means in the pattern arrangement direction in accordance with the stitch data stored in said stitch data storage means.

7. The sewing machine according to claim 5, further comprising pattern length data storage means for storing therein pattern length data representing length of the plurality of predetermined patterns in the pattern arrangement direction.

8. The sewing machine according to claim 7, wherein said read-out means further reads from said pattern length data storage means a plurality of pattern length data individually corresponding to a plurality of patterns combined by said combination designating means, and wherein said calculating means further calculates a total lengthwise dimension in the pattern arrangement direction of a combination pattern based on pattern length data read by said read-out means.

9. The sewing machine according to claim 8, wherein said display means further displays a lengthwise dimension calculated by said calculating means.

10. A sewing machine capable of forming a plurality of stitch patterns, comprising:

pattern selecting means for selecting a desired pattern from a plurality of predetermined patterns;

combination designating means for successively combining patterns selected by said pattern selecting means juxtaposed in a pattern arrangement direction to form a combination pattern;

stitch forming means for forming the combination pattern comprising at least one pattern;

pattern dimension storage means for storing therein pattern width data representing pattern widthwise dimensions of each pattern selected in a pattern widthwise direction perpendicular to the pattern arrangement direction;

read-out means for successively reading from said pattern dimension storage means the pattern width data for each pattern stored in said pattern dimension storage means;

data selecting means for selecting, from among the pattern width data read by said read-out means, pattern width data representing the greatest pattern widthwise dimension which defines a distance between a lowermost position and uppermost position in the pattern widthwise direction, said lowermost position being lowest among all lowermost positions of the plurality of predetermined patterns and said uppermost position being highest among all uppermost positions of the plurality of predetermined patterns; and display means for displaying the greatest pattern widthwise dimension in accordance with pattern width data selected by said data selecting means.

11. The sewing machine according to claim 10, further comprising:

stitch data storage means for storing therein stitch data corresponding to the plurality of predetermined patterns, wherein said stitch forming means forms a plurality of stitch patterns combined by said combination designating means in the pattern arrangement direction in accordance with the stitch data stored in said stitch data storage means.

12. The sewing machine according to claim 10, wherein said pattern dimension storage means further stores pattern length data representing pattern lengthwise dimensions of each pattern selected.

13. The sewing machine according to claim 12, further comprising calculating means for calculating a length of the combination pattern based on the pattern length data stored in said pattern dimension storage means.

14. The sewing machine according to claim 13, wherein said pattern dimension storage means further stores said pattern width data for each selected pattern as lowermost position data and uppermost position data relative to a fabric feed direction.

15. The sewing machine according to claim 14, wherein said calculating means further calculates a maximum widthwise dimension in the pattern widthwise direction based on data from each pattern selected by said selecting means:

said read-out means reads the uppermost position data and lowermost position data for each pattern stored in said data storage means;

said selecting means selects from among the lowermost position data and the uppermost position data of each pattern read by said read-out means a greatest lowermost position data and a greatest uppermost position data for use by said calculating means to calculate said maximum widthwise dimension.

* * * * *